US009518389B1

(12) United States Patent
McDanal

(10) Patent No.: US 9,518,389 B1
(45) Date of Patent: Dec. 13, 2016

(54) CONTROLLED FLOW ROOF DRAIN

(71) Applicant: Jay R. Smith Mfg. Co., Montgomery, AL (US)

(72) Inventor: Stephen J. McDanal, Montgomery, AL (US)

(73) Assignee: Jay R. Smith Mfg. Co., Montgomery, AL (US)

( * ) Notice: Subject to any disclaimer, the term of this patent is extended or adjusted under 35 U.S.C. 154(b) by 0 days.

(21) Appl. No.: 14/757,182

(22) Filed: Dec. 1, 2015

(51) Int. Cl.
*E04D 13/04* (2006.01)

(52) U.S. Cl.
CPC ..... *E04D 13/0409* (2013.01)

(58) Field of Classification Search
CPC ..... E04D 13/0409
USPC ..... 210/163, 166
See application file for complete search history.

(56) References Cited

U.S. PATENT DOCUMENTS 853,598 A * 5/1907 Rile ..... E04D 13/0409 210/166
1,434,254 A * 10/1922 Sanders ..... E04D 13/0409 210/163
2,283,160 A * 5/1942 Boosey ..... E04D 13/0409 210/163
3,357,561 A 12/1967 Schmid et al.
3,447,329 A 6/1969 Emberson
3,469,698 A * 9/1969 Blendermann ..... E04D 13/0409 210/163
3,469,699 A 9/1969 Blendermann et al.
3,517,813 A 6/1970 Thaler
3,529,723 A 9/1970 Hagedorn
3,909,412 A * 9/1975 Patry ..... E04D 13/0409 210/166
4,112,691 A 9/1978 Ebeling et al.
4,525,273 A 6/1985 Logsdon
5,526,613 A 6/1996 Simeone
6,594,966 B2 7/2003 Froeter
7,011,746 B2 * 3/2006 Bockmann ..... E04D 13/0409 210/164
7,614,198 B1 11/2009 Piskula et al.

FOREIGN PATENT DOCUMENTS

DE 29505860 U1 * 5/1996

* cited by examiner

*Primary Examiner* — Jeanette E Chapman
(74) *Attorney, Agent, or Firm* — William S. Ramsey

(57) ABSTRACT

Embodiments include controlled flow rood drains which minimize the size of drainage piping and meet established maximum flow rates by draining built-up water from a flat roof. Embodiments are pre-set by the manufacture in terms of the diameter of the standpipe orifice, which controls maximum flow rate at a predetermined depth of water on the roof, and the height of the standpipe, which determines the depth of water on the roof. Embodiments resist alteration of the flow rate by vandals, tenants, or managers of the building, and are resistant to flow which bypasses the drain control and resistant to plugging by roof debris or snow.

1 Claim, 4 Drawing Sheets

CONTROLLED FLOW ROOF DRAIN

BACKGROUND OF THE INVENTION

Field of the Invention

Embodiments relate to roof installed gated inlet surface drains.

BRIEF SUMMARY OF THE INVENTION

The efficient drainage of water from flat roofs is an important issue in the construction of commercial buildings. It is important for two reasons to restrict the rate of removal of water from such roofs. Firstly, the capacity of municipal storm sewers often dictate a mandatory limitation on the rate of water which can be removed from a roof and placed in a storm sewer for disposal. Secondly, the cost of drain lines and connector lines which run to the sewer connection constitute a substantial portion of the cost of building manufacture. It is important to minimize the size and thus the cost of these lines.

On the other hand, it is important not to exceed the maximum flow rate for the system. If water is removed from the roof at greater than the design maximum flow rate the system will be overwhelmed, with the risk of backflow of water from some drains, as well as the risk of exceeding the mandatory limitation.

A common method of minimizing the rate of water removed from a flat roof is to use the roof itself as a reservoir for rain or melted snow water, thereby extending the time available to remove the water from a storm at an optimum controlled rate. The water is allowed to build up to a predetermined height while the excess is drained off at a predetermined maximum rate.

In determining the maximum flow rate for a single drain the engineer begins with the 100-year 1-hour rainfall for the location of the installation, the square footage of the roof, and the nature of the roof, i.e. whether it is flat or with a rise or rises, and the structural strength of the roof. Of course, the roof can be used to store rain water only if it is fully waterproof and of sufficient strength to accept the loading of the water. Other engineering considerations, such as the existence and location of parapet walls, wind effects on build-up, and the possibility of roof deflection which could create low spots, must be considered in the drainage design.

Alternatively, local codes may dictate the number and location of drains, maximum flow rates for each drain and the maximum allowable build-up.

Embodiments include a drain which controls the rate of drainage of water from a flat roof which comprises a cup-shaped body having a connector for connection of the body to a drain pipe. A disk-shaped collar with a hole in the center of the collar is attached to the top of the body and the collar is attached to the roof. A standpipe with a first and a second end, the standpipe having a circular orifice in the side of the standpipe, is connected by the first end coaxially to the hole in the collar with the lowest portion of the orifice on the side of the standpipe approximately at the level of the collar. A grated dome which covers the standpipe is attached to the body. The drain is attached to the roof with the collar level with the surface of the roof, the height of the second end of the standpipe above the collar is the same as the maximum allowed depth of water on the roof, and the diameter of the orifice is adequate to allow the maximum rate of water flow through the orifice at the pressure determined by the maximum allowed depth of water on the roof.

The following embodiments and aspects thereof are described and illustrated in conjunction with systems, tool and methods which are meant to be exemplary and illustrative, not limiting in scope. In various embodiments, one or more of the above-described problems have been reduced or eliminated, while other embodiments are directed to other improvements.

In addition to the exemplary aspects and embodiments described above, further aspects and embodiments will become apparent by reference to the drawings and by study of the following descriptions.

BRIEF DESCRIPTION OF THE SEVERAL VIEWS OF THE DRAWING(S)

DETAILED DESCRIPTION OF THE INVENTION

In this disclosure the term "flat roof" means a roof which is horizontal throughout; as well as a sloped roof—single rise, a roof with a single rise; a sloped roof—double rise, a roof with a double rise; or a sloped roof—multiple rise, a roof with greater than two rises. The rise is measured vertically from the low point or valley to the high point or ridge and does not exceed 6 inches. The rise is measured vertically from the low point or valley to the high point or ridge of the roof. In this disclosure the term "drain line" means drain pipes, leaders, storm sewers and other pipes which accept water from the roof drains. The term "build-up" means the maximum depth of water on the roof at the drain. In this disclosure the build-up limit is 3 inches for completely level roofs; 4 inches for roofs with a 2 inches rise; 5 inches for roofs with a 4 inch rise; and 6 inches for roofs with a 6 inch rise.

Figure 1:
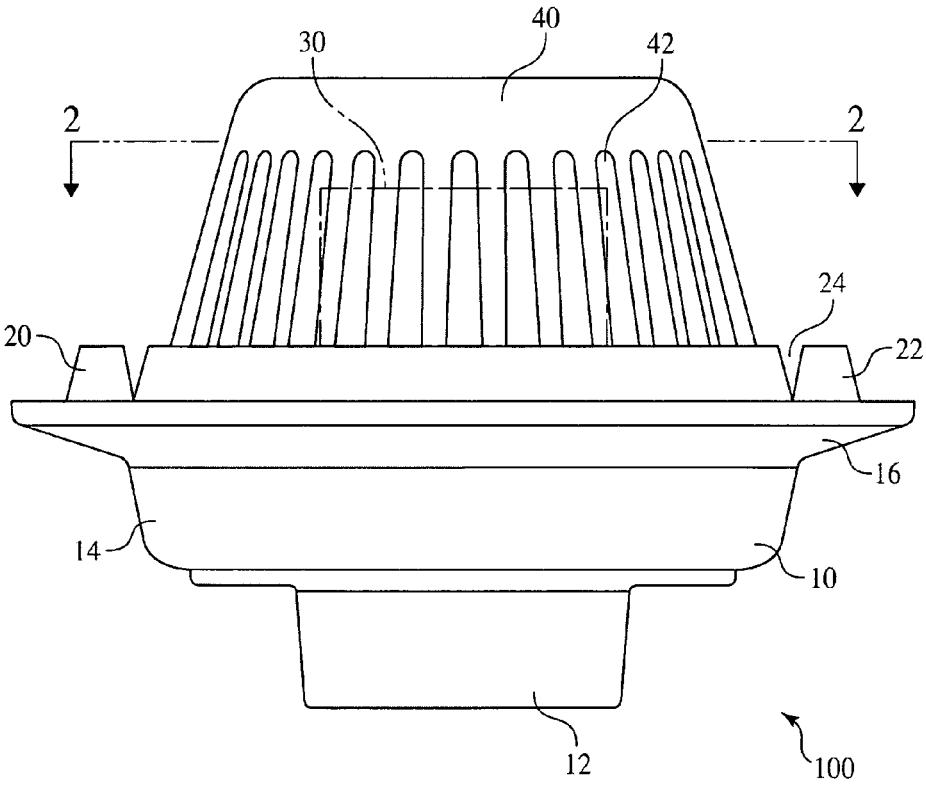
FIG. 1 is a side view of an embodiment drain.

FIG. 1 is a side view of an embodiment drain 100. Visible in FIG. 1 is the body 10 with sump 14, outlet 12, and rim 16. A collar 20 with a gravel stop 22 with multiple notches 24 also is shown. Visible above the collar is the dome 40 with side grate 42 openings. The location of a standpipe 30 inside the dome is indicated by dashed lines.

Figure 2:
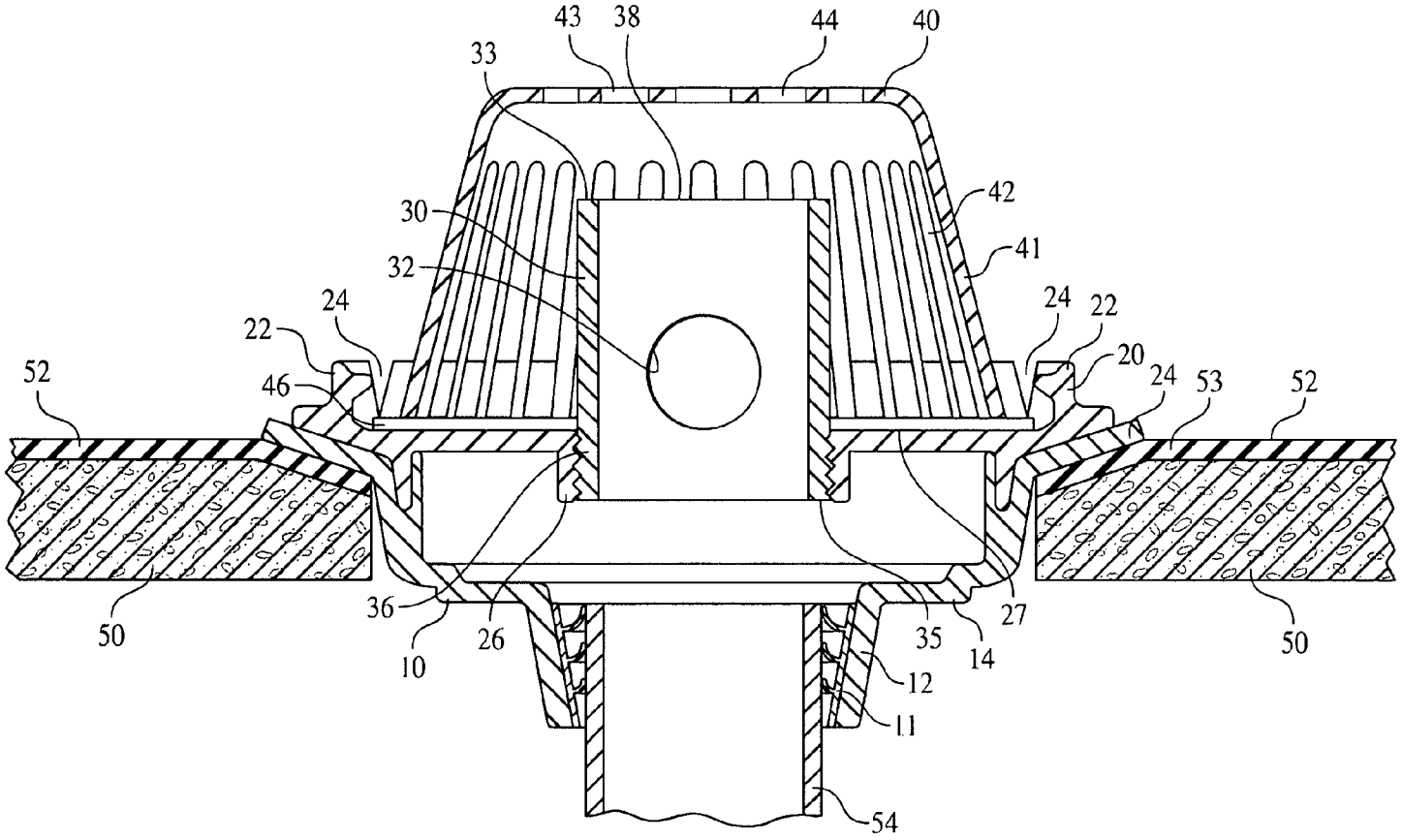
FIG. 2 is a cross-section view of an embodiment drain taken at 2-2 of FIG. 1 and installed on a flat roof.

FIG. 2 is a cross-section view of an embodiment drain taken at 2-2 of FIG. 1 and installed on a flat roof. Visible in FIG. 2 is the drain body 10 showing the sump 14, outlet 12, drain pipe fastener 11, and rim 16. Also visible is the collar 20 which rests on the rim 16 with gravel stop 22 which has notches 24 which allow water to pass through the gravel stop 22. A standpipe hole 25 is in the center of the collar and has a threaded connector 26 which interacts with threaded connector 36 at the second end of standpipe 30 and secures the standpipe in place with the orifice 32 located with the lowest portion of the orifice at the level of the upper surface 27 of the collar 20. The upper surface 27 of the collar 20 is at the level of the upper surface 53 of the roof which is the top of the membrane 52 in the embodiment of FIG. 2. Standpipe 30 also has a cap or closure 38 at the first end 33 of the standpipe in this embodiment. The roof body 50 is shown as a concrete structure in this embodiment.

Also visible in FIG. 2 is the dome 40 showing the side 41 with grated openings 42 and the top 43 of the dome with top grate 44 openings. A rim 46 is at the bottom of the dome and has a vandal-resistant latch which interacts with a latch on the collar (not shown in FIG. 2).

The embodiment in FIG. 2 has a body with a straight-sided outlet 12 which uses a rubber drain pipe fastener 11 to connect with the drain pipe 54. A suitable body is the no-hub body obtainable from J.R. Smith Mfg. Co., Montgomery, Ala. A suitable drain pipe connector is the SPEEDI-SET gasket obtainable from J.R. Smith Mfg. Co. SPEEDI-SET is a trademark for gaskets belonging to the J.R. Smith Mfg. Co.

Other connector types for connecting the drain pipe and drain body are specifically contemplated. In particular, a connection which comprises oakum and lead is specifically contemplated. The connection of a no-hub body to a drain pipe using a no-hub clamp is specifically contemplated.

While not depicted in FIG. 2, a variety of means may be used to securely connect the drain with the roof, for example, an under deck clamp. Such a clamp is a halo-shaped flange through which the drain body extends, which bears against the bottom side of the roof, and which is secured to the drain body by bolts.

Figure 3:
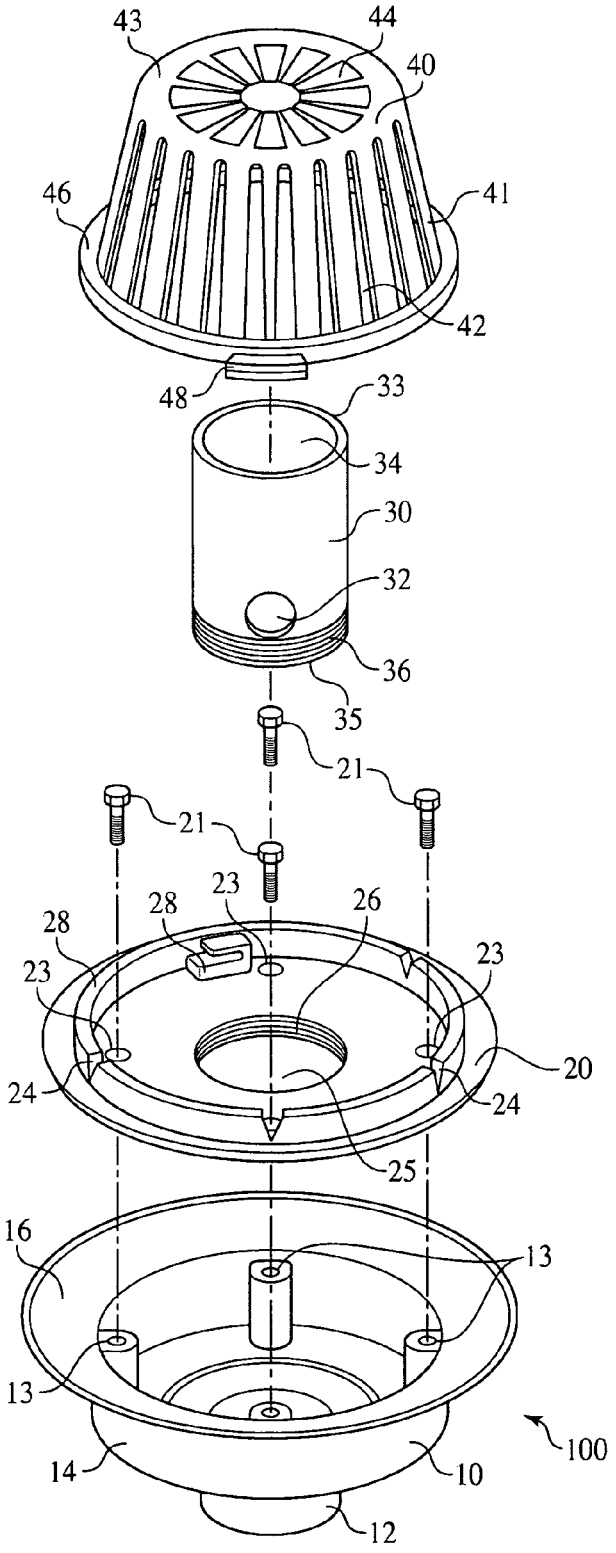
FIG. 3 is an exploded view of an embodiment drain.

FIG. 3 is an exploded view of an embodiment drain 100. Visible in FIG. 3 is the body 10 with drain pipe connector 10, sump 14, fastener receivers 13, and rim 16. Also visible in FIG. 3 is the collar 20 with gravel stop 22, notches 24, and fastener holes 23. Also visible is a standpipe hole 25 located in the center of the collar. The circumference of the hole is threaded 26 for interaction with the threads 36 at the first 35 end of the standpipe 30. A vandal-resistant latch 28 for securing the dome to the collar is shown in FIG. 3. Threaded bolt fasteners 21 extend through the holes 23 and interact with threaded fastener receivers 13 to secure the collar 20 to the body 10. A standpipe 30 is shown with a second end 33 with an opening 34 in this embodiment standpipe. An orifice 32 is shown on the side of the standpipe. The first end 35 of the standpipe is threaded 36 and interacts with the threads 26 on the collar hole 25 to secure the standpipe in the collar. Also visible is a truncated cone-shaped dome 40 with sides 41 with grated 42 openings. The top 43 of the dome has grated 44 openings. A vandal-resistant dome latch 48 interacts with the collar latch 28 to secure the dome in position on top of the collar.

In embodiments, the fasteners which attach the collar to the body are bolts. Other suitable fasteners include screws, pegs, pins, and grommets.

In embodiments, the standpipe is attached to the collar through a joint with threads on the outer circumference of the standpipe which interact with corresponding threads on the circumference of the hole in the center of the collar. Other types of joints between the standpipe and collar are specifically contemplated, such as a bayonet mount, friction joint, permanent or semi-permanent joints such as by welding, soldering, or adhesive joints.

In embodiments, the dome is attached to the collar by a vandal-resistant latch. Other suitable attachment mechanisms, including lugs and a bayonet locking device are specifically contemplated.

Figure 4:
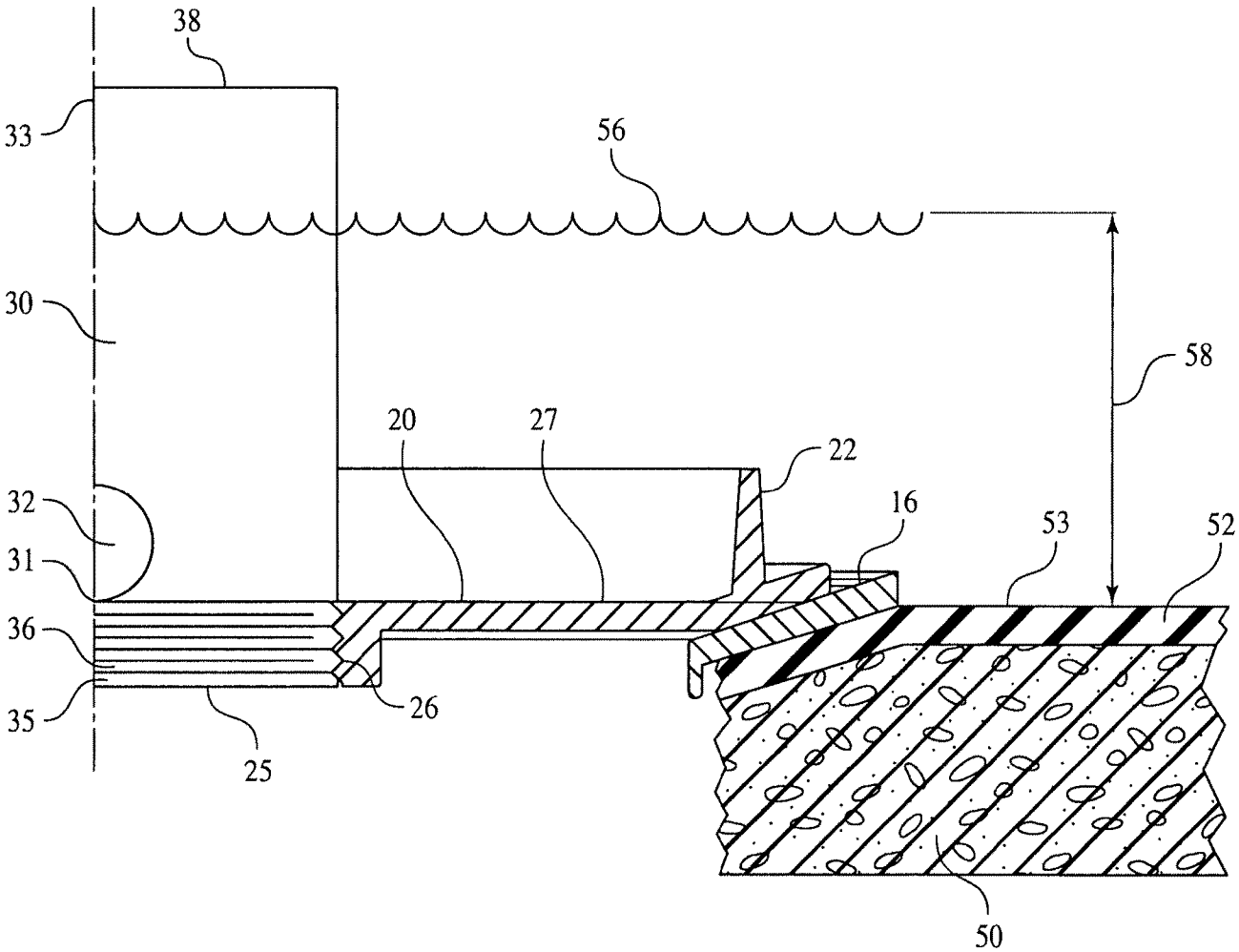
FIG. 4 is a cross-section diagram showing the relationship between orifice location and head height in an embodiment drain.

FIG. 4 is a cross-section diagram showing the relationship between orifice location and head height in an embodiment drain. Visible in FIG. 4 is the roof body 50 with membrane 52 and upper surface 53 of roof, here the upper surface of the membrane 52. The body rim 16 is shown as well as the collar 20 with gravel stop 22, upper surface 27 of collar, standpipe hole 25 and threaded 26 standpipe connector on the collar. The standpipe 30 is shown with orifice 32 and threaded 36 first end 35 of the standpipe. In this embodiment standpipe a cover 38 is located at the first end 35 of the standpipe. The height of the head 58 is the maximum allowable height of water 56 allowed to accumulate at the drain. Note the lowest portion 31 of the orifice 32 is at the level of the upper surface 53 of the roof.

Embodiment drains are manufactured of any strong, durable, impermeable materials. Embodiment domes, standpipes, collars and bodies are manufactured of polyethylene, other plastics, aluminum, bronze, steel, stainless steel, galvanized cast iron and cast iron.

Embodiment roof drains serve to drain water from flat roofs at a predetermined maximum rate.

In embodiments, the maximum drain rate through the orifice, which determines the maximum drain rate through the drain, is set by the manufacturer and cannot be altered. Similarly, the maximum build-up of water, which is determined by the height of the standpipe above the collar, or by overflow drains, is set by the manufacturer and cannot be altered by the user. These provisions insure durability, reduce the cost of manufacture, eliminate the possibility of inadvertent alteration of settings controlling flow rate and build-up, and prevent deliberate or inadvertent alteration of the flow rate and build-up by builders, tenants, or vandals.

In embodiments, the drain is permanently mounted on the roof. This insures that water cannot infiltrate under the collar and by-pass the build-up control of the standpipe, despite the existence of irregularities in the surface of the roof. Furthermore, excessive winds cannot shift, tip-over, or remove embodiment drains.

In embodiments, the second end of the standpipe is closed. In these embodiments the drain acts solely as a means for providing controlled drainage from a flat roof.

In embodiments, the second end of the standpipe is open. In these embodiments the length of the standpipe is set so that the top of the standpipe is the same height above the roof as the allowed depth of build-up. Here the drain has two functions, that of providing controlled drainage from a flat roof, and that of acting as an emergency drain under the unusual conditions of orifice plugging. An orifice might be plugged by icing conditions or be an unusual accumulation of mud or debris on the roof.

In embodiments, the orifice is sized as follows:

Step 1. Determine the allowable drainage rate for the roof from the municipality officials.

Step 2. Determine the roof area for an individual drain.

Step 3. Calculate the maximum controlled flow gallons per minute (GPM) for each roof drain based on rainfall intensity and square footage of the roof and the allowable drainage rate for the roof.

Step 4. Set the maximum build-up by the height of the overflow drains.

Step 5. Calculate the orifice size based on the required controlled flow GPM per drain Using McNally Institute "Approximate flow through an orifice" as in Formula 1.

$$Q=448.8\times K\times A\times\sqrt{2gh} \text{ when} \qquad \text{Formula 1}$$

Q=controlled flow GPM per drain 448.8=conversion factor from cubic foot per second to GPM.

K=orifice constant=0.512.

A=orifice area in square feet.

g=specific gravity of 32.2 ft/sec$^2$.

h=head at orifice in feet.

Example 1

The orifice size for embodiment example "A" is calculated using Formula 1 as follows: Q for embodiment A=12 GPM at 0.25 ft head.

$$12=448.8\times K\times A\times\sqrt{2gh}$$

$$12=448.8\times 0.512\times A\times 4.012$$

$$12=922\times A$$

A=0.013 square feet. This indicates an orifice diameter of 1.54 inches.

While a number of exemplary aspects and embodiments have been discussed above, those of skill in the art will recognize certain modifications, permutations, additions and sub combinations thereof. It is therefore intended that the following appended claims and claims hereafter introduced are interpreted to include all such modifications, permutations, additions and sub-combinations as are within their true spirit and scope. The applicant or applicants have attempted to disclose all the embodiments of the invention that could be reasonably foreseen. There may be unforeseeable insubstantial modifications that remain as equivalents.

I claim:

1. The process for determining the size of the orifice of a drain which controls the rate of drainage of water from a flat roof comprising the steps:

a. obtaining a drain comprising a cup-shaped body having a connector for connection of the body to a drain pipe, a disk-shaped collar with a hole in the center of the collar, the collar attached to the top of the body, the collar attached to the roof, a standpipe with a first and a second end, the first end of the standpipe open, the standpipe having a circular orifice in the side of the standpipe near the first end, the standpipe connected by the first end coaxially to the hole in the collar, the lowest portion of the orifice on the side of the standpipe approximately at the level of the collar, and a grated dome attached to the body, the drain attached to the roof with the collar level with the surface of the roof, wherein the height of the second end of the standpipe above the collar is the same as the maximum allowed depth of water on the roof, b. determining the allowable drainage rate for the roof, c. determining the roof area for an individual drain, d. determining the drain down rate in GPM for each drain based on 100 year expected rainfall for the location of the roof and the maximum build-up, and e. calculating the orifice size based on the required controlled flow GPM per drain using the formula: $Q=448.8\times K\times A\times\sqrt{2gh}$, when Q=controlled flow GPM per drain; 448.8=conversion factor from cubic foot per second to GPM; K=orifice constant=0.512; A=orifice area in square feet; g=specific gravity of 32.2 ft/sec$^2$ and h=head at orifice in feet.

* * * * *